US007860427B2

(12) United States Patent
Hayashi et al.

(10) Patent No.: US 7,860,427 B2
(45) Date of Patent: Dec. 28, 2010

(54) TONER CARTRIDGE AND IMAGE FORMING APPARATUS USING THE SAME

(75) Inventors: Shigeki Hayashi, Osaka (JP); Jun Yamaguchi, Osaka (JP); Takeshi Okuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 24 days.

(21) Appl. No.: 12/501,532

(22) Filed: Jul. 13, 2009

(65) Prior Publication Data

US 2010/0008693 A1 Jan. 14, 2010

(30) Foreign Application Priority Data

Jul. 14, 2008 (JP) ..... 2008-182648

(51) Int. Cl.
*G03G 15/00* (2006.01)

(52) U.S. Cl. ..... 399/90; 399/262

(58) Field of Classification Search ..... 399/9, 399/12, 24, 25, 31, 75, 90, 119, 120, 252, 399/258, 262; 439/247
See application file for complete search history.

(56) References Cited

U.S. PATENT DOCUMENTS 7,218,866 B2 * 5/2007 Hayashi et al. ..... 399/12
7,258,558 B1 * 8/2007 Dawson et al. ..... 439/247

FOREIGN PATENT DOCUMENTS

JP 11-242371 A 9/1999
JP 2001-022230 1/2001
JP 2003-228210 8/2003
WO 2008/038428 4/2008

OTHER PUBLICATIONS

Office Action for corresponding Japanese Application No. 2008-182648 mailed Apr. 27, 2010.

* cited by examiner

*Primary Examiner*—Hoan Tran
(74) *Attorney, Agent, or Firm*—Renner, Otto, Boisselle & Sklar, LLP

(57) ABSTRACT

A toner cartridge includes: a toner container for containing a toner, the toner container being removably mounted in an image forming apparatus; and a storage section for electronically storing specific information held by the toner container, the storage section being electrically connected to a to-be-connected portion of the image forming apparatus when the toner container is mounted in the image forming apparatus, the storage section having: a board assembly including a board on which a storage element for storing the specific information held by the toner container as electronic information is mounted; a housing member for holding the board assembly; and a covering member for detachably integrating the board assembly and the housing member, the storage section being attachable to and removable from the toner container.

7 Claims, 6 Drawing Sheets

TONER CARTRIDGE AND IMAGE FORMING APPARATUS USING THE SAME

CROSS-REFERENCE TO RELATED APPLICATIONS

This application is related to Japanese application No. 2008-182648 filed on Jul. 14, 2008, whose priority is claimed under 35 USC §119, the disclosure of which is incorporated by reference in its entirety.

BACKGROUND OF THE INVENTION

1. Field of the Invention

The present invention relates to a toner cartridge and an image forming apparatus using the same. More particularly, the present invention relates to a toner cartridge removably mounted in an image forming apparatus utilizing an electrophotographic system, an electrostatic recording system or the like, and to an image forming apparatus using the toner cartridge.

2. Description of the Related Art

Examples of image forming apparatuses utilizing an electrophotographic system or an electrostatic recording system include copying machines, printers, facsimile machines, multifunction peripherals and the like. In such image forming apparatuses, an electrostatic latent image is formed on a photoconductor, and a toner is supplied from a developing device to the photoconductor. Then, a toner image is formed on the photoconductor by developing the electrostatic latent image on the photoconductor with the toner. The toner image is transferred from the photoconductor to a paper sheet followed by heating and pressing to fix the toner image on the paper sheet.

Since toner is gradually consumed as image formation is repeated, it is necessary to appropriately supply toner to compensate for the consumed toner. For example, a hopper is provided on a developing device, and a toner cartridge is removably attached onto the hopper, thereby allowing toner to fall from the toner cartridge to the hopper and supplying the toner from the hopper to the developing device.

Then, the amount of remaining toner in the toner cartridge is detected and pixels are counted to calculate the amount of consumed toner to urge a user to replace the toner cartridge when the amount of remaining toner is getting low, thereby preventing toner shortage.

As described above, toner cartridges are expendables, and a used toner cartridge after replacement is collected by a supplier, recycled, and then sent to a user again as a recycled toner cartridge.

Meanwhile, since toner cartridges are products of a character of being distributed as expendables in a market, false products that have compatibility with genuine products only in appearance may be unfortunately available to consumers.

However, image quality has been improved in recent image forming apparatuses, and toner has been also required to deliver high performance corresponding to the improved image quality. Therefore, use of non-genuine toner cartridges results not only in failure to obtain aimed image quality but also in pollution inside the apparatuses to be a cause of malfunction.

Even in genuine toner cartridges, physical properties of a contained toner are slightly different every production lot, and such a slight difference in the physical properties according to the production lot may have an influence on the image quality in the recent image forming apparatuses that are required to provide high image quality.

Furthermore, recycling of a toner cartridge cannot be repeated again and again unlimitedly, and the number of times of the recycling that can be repeated is limited according to the mechanical lifetime of the toner cartridge body.

As described above, the circumstances surrounding toner cartridges are getting complicated, and in recent years, there has been produced a toner cartridge in which a storage section is provided where information is rewritable electronically so that the storage section holds information specific to the toner cartridge.

For example, a toner cartridge is known that is provided with a non-contact communication IC tag where information is rewritable electronically and that is configured to perform transmission and reception of data by a non-contact system with an image forming apparatus in which the toner cartridge is mounted (see, for example, Japanese Unexamined Patent Publication No. 2001-22230).

In the toner cartridge disclosed in Japanese Unexamined Patent Publication No. 2001-22230, information specific to the toner cartridge such as product number, production lot No., number of times of recycling can be held by a non-contact communication IC tag provided to the toner cartridge.

Therefore, it is possible to aim at prevention of use of false products, correction of an influence on the image quality due to toner physical properties that are different every production lot, prevention of recycling beyond the upper limit of the number of times and the like, by reading out the information held by the non-contact communication IC tag in the image forming apparatus in which the toner cartridge is mounted.

However, since the toner cartridge disclosed in Japanese Unexamined Patent Publication No. 2001-22230 transmits and receives data by a non-contact system, malfunction may be caused due to an influence given by noise generated from other electronic components in the image forming apparatus.

In view of costs, in addition, revaluation has been made on a contact system in which a storage section provided to a toner cartridge is physically connected to an image forming apparatus.

In the contact system, however, the storage section is also physically connected to the image forming apparatus when the toner cartridge is mounted in the image forming apparatus, and therefore a connecting portion where the storage section is connected to the image forming apparatus may be broken in some cases if an inexperienced user mounts the toner cartridge in an incorrect manner or in a rough manner. When the connecting portion where the storage section is connected to the image forming apparatus is broken, recycling of the toner cartridge itself will be difficult.

In addition, even if the number of times of the recycling of the toner cartridge reaches the upper limit thereof in terms of mechanical durability, the storage section is still reusable in most cases, because the storage section is basically free from a structural burden except for the time of connection to and separation from the image forming apparatus.

SUMMARY OF THE INVENTION

In view of the above-described circumstances, the present invention has been achieved to provide a toner cartridge mounting a storage section and an image forming apparatus using the same, the storage section having less incidence of malfunction, being easily disassembled and repaired even when broken, and being reusable even when the number of times of recycling of the toner cartridge reaches the upper limit thereof.

The present invention provides a toner cartridge, comprising: a toner container for containing a toner, the toner container being removably mounted in an image forming apparatus; and a storage section for electronically storing specific information held by the toner container, the storage section being electrically connected to a to-be-connected portion of the image forming apparatus when the toner container is mounted in the image forming apparatus, the storage section comprising: a board assembly including a board on which a storage element for storing the specific information held by the toner container as electronic information is mounted; a housing member for holding the board assembly; and a covering member for detachably integrating the board assembly and the housing member, the storage section being attachable to and removable from the toner container.

According to the toner cartridge of the present invention, the storage section for electronically storing the specific information held by the toner container is electrically connected to the to-be-connected portion of the image forming apparatus when the toner container is mounted in the image forming apparatus.

Therefore, the toner cartridge of the present invention is less likely to be affected by noise generated by other electronic components on the occasion of reading/writing of the specific information between the storage section and the image forming apparatus and less likely to cause malfunction due to such noise.

In addition, the storage section comprises: a board assembly including a board in which a storage element for storing the specific information as electronic information is mounted; a housing member for holding the board assembly; and a covering member for detachably integrating the board assembly and the housing member.

Thus, the storage section can be composed of only three components and easily disassembled by removing the covering member, even when a connecting portion of the storage section is damaged when the storage section is connected or separated. Then, the storage section can be reused by carrying out repair such as replacement of a component suffering from the damage.

Besides, since the storage section is removable from the toner container, the storage section can be reused by being removed from the toner container even when the number of times of recycling of the toner container reaches the upper limit thereof, leading to effective utilization of resources. It is needless to say that the storage section can be disassembled to undergo repair if necessary, by removing the covering member on the occasion of the reuse, as described above.

DESCRIPTION OF THE PREFERRED EMBODIMENTS

Figure 1:
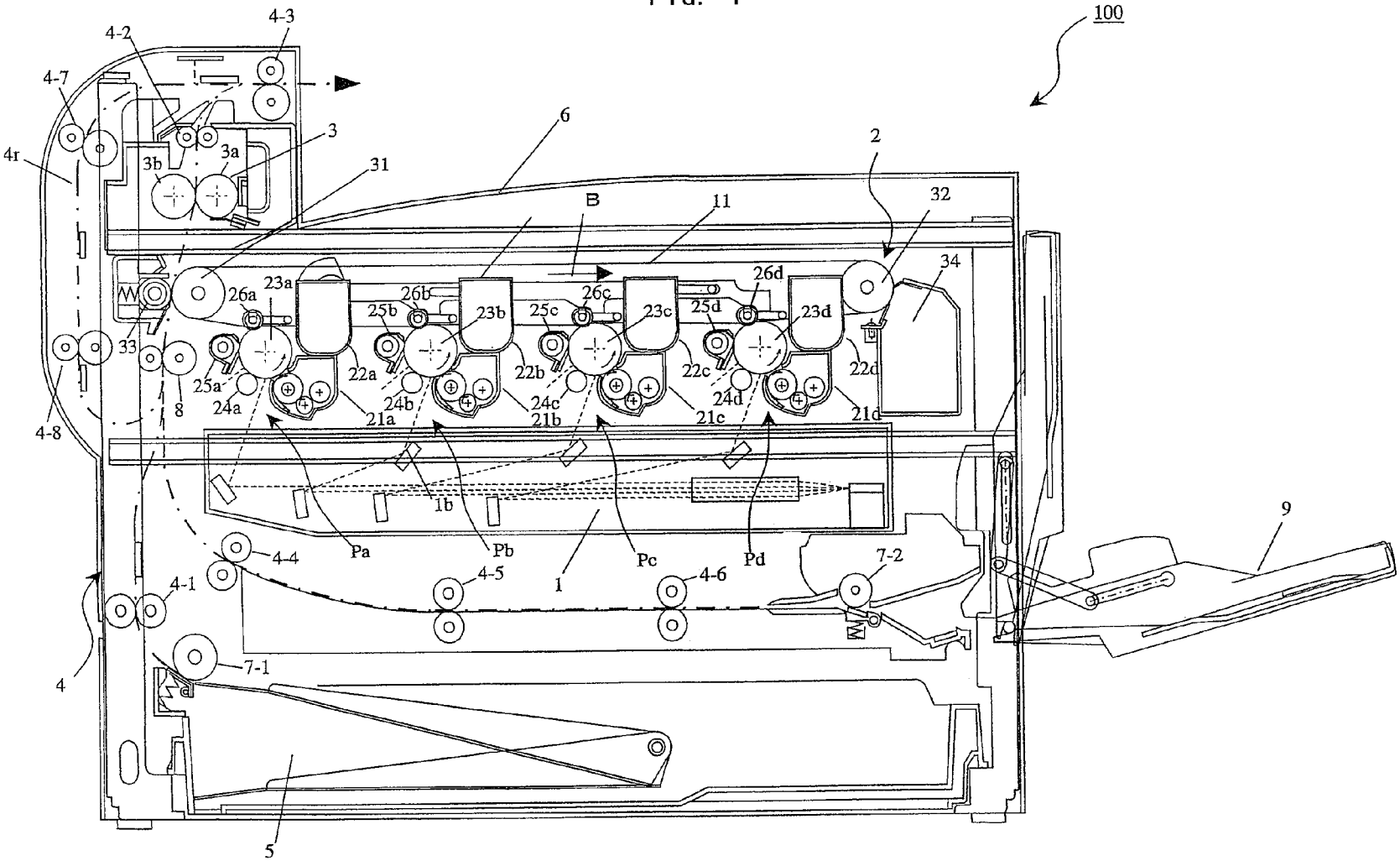
FIG. 1 is an explanatory diagram schematically illustrating an entire configuration of an image forming apparatus according to an embodiment of the present invention.

A toner cartridge according to the present invention comprises: a toner container for containing a toner, the toner container being removably mounted in an image forming apparatus; and a storage section for electronically storing specific information held by the toner container, the storage section being electrically connected to a to-be-connected portion of the image forming apparatus when the toner container is mounted in the image forming apparatus, the storage section comprising: a board assembly including a board on which a storage element for storing the specific information as electronic information is mounted; a housing member for holding the board assembly; and a covering member for detachably integrating the board assembly and the housing member, the storage section being attachable to and removable from the toner container.

The image forming apparatus referred to regarding the toner cartridge of the present invention means general image forming apparatuses in which an image is formed on a recording medium by an electrophotographic system or an electrostatic recording system with the use of a photoconductor and a toner.

The toner container means a container that contains a toner for the purpose of supplying the toner to the image forming apparatus and that is formed so as to be attached to and removed from the image forming apparatus. The toner cartridge referred to in the present invention is one composed of the toner container with the storage section added thereto.

The specific information held by the toner container includes both general information common to toner containers of the same type and information unique to each individual toner cartridge.

Information included in the specific information can be roughly classified to the following three kinds of information: body information, history information, and recycling information, for example.

Here, the body information includes, for example, product number, capacity, color of contained toner, lot No., production date, name of manufacturer, address and phone number of manufacturer, and the like.

The history information includes, for example, amount of remaining toner, start date of use, actual total time of use, and the like.

The recycling information includes number of times of recycling, date of recycling, name of collector, address and phone number of collector, and the like.

The specific information is stored mainly for the following purposes: (1) to carry out accurate toner supply control, (2) to obtain desired image quality, (3) to know in advance when to replace, (4) to prevent use of false products (poor-quality products), and the like.

Then, the specific information is utilized for the following purposes, for example: to urge a user to replace a toner cartridge when the toner cartridge is not a genuine product (recommended product), to urge a user to prepare a next toner cartridge when the amount of remaining toner is getting low, to change conditions of image formation according to the lot No., to correct the amount of toner to be supplied, or the like.

In the image forming apparatus according to the present invention, the housing member may have a guiding path to which the board assembly is inserted and a rib contacting with an edge of the board assembly inserted to the guiding path for positioning the board assembly to a predetermined position in the housing member.

Such a configuration facilitates incorporation of the board assembly into the housing member, allowing the board assembly to be inserted along the guiding path of the housing member.

For the positioning, in addition, the edge of the board assembly contacts with the rib when the board assembly is inserted to the predetermined position in the housing member, and therefore breakage or damage of the board assembly on the occasion of the assembly can be prevented to the extent possible.

In the above-described configuration in which the housing member has a guiding path and a rib, the rib of the housing member may include: side edges respectively formed so as to rise from opposite edges of the guiding path, and a front end formed so as to rise from an end of the guiding path and joining ends of the side edges together. The front end may act as a front end of the storage section when the storage section is electrically connected to the to-be-connected portion of the image forming apparatus, and both ends of the front end linked to the side edges may be rounded.

According to this configuration, the front end of the rib acting as the front end of the storage section when the storage section is connected to the to-be-connected portion of the image forming apparatus is formed to have the rounded ends linked to the side edges, and therefore it is likely that the storage section is connected smoothly without being caught by the to-be-connected portion of the image forming apparatus on the occasion of the mounting of the toner container, thereby preventing damage of the connecting portion of the storage section.

In the toner cartridge according to the present invention, the board assembly may have a plurality of electrode terminals extending from the storage element on the board and electrically connected to the to-be-connected portion of the image forming apparatus when the toner container is mounted in the image forming apparatus, and the plurality of electrode terminals may be arranged so as to line up on the board in parallel along a connecting direction toward the to-be-connected portion.

According to this configuration, the plurality of electrode terminals are arranged on one flat surface of the board, and therefore the structure of the storage section is simplified compared to the case where the electrode terminals are arranged on a plurality of surfaces, thereby facilitating the assembly.

In the above-described configuration in which the board assembly has a plurality of electrode terminals arranged on the board in parallel, the plurality of electrode terminals may include at least one ground terminal, and an end of the ground terminal may extend toward the connecting direction longer than the other terminals.

When the storage section is connected to the to-be-connected portion of the image forming apparatus, according to this configuration, the ground terminal contacts with the to-be-connected portion first, and then the other terminals contact with the to-be-connected portion. In addition, when the storage section is separated from the to-be-connected portion of the image forming apparatus, the terminals other than the ground terminal are disconnected from the to-be-connected portion, and then the ground terminal is disconnected from the to-be-connected portion last.

Containing a toner, which is a fine powder, the toner container of the toner cartridge is prone to be charged with static electricity due to flow of the toner. In particular, the toner container can be charged with as much as thousands volt of static electricity in a low-humidity environment in winter.

Then, if the static electricity gets on the storage section via the toner container, the static electricity on the storage section is discharged in bursts when the storage section is connected to the to-be-connected portion of the image forming apparatus.

This discharge appears as noise of the storage section to counteract correct detection of an output voltage from the storage section in the image forming apparatus in which the toner cartridge is mounted or to be detected as an abnormal output voltage value, causing malfunction in the storage section or the image forming apparatus.

However, in the above-described configuration of the present invention in which the ground terminal is longer than the other terminals, the storage section is connected to the to-be-connected portion of the image forming apparatus so that the ground terminal is connected earlier than the other terminals, that is, the other terminals will be connected after the storage section is grounded through the ground terminal.

In addition, when the storage section is separated from the to-be-connected portion, the storage section will stay grounded while the other terminals are connected to the to-be-connected portion of the image forming apparatus, because the ground terminal is separated later than the other terminals.

Therefore, it is possible to prevent malfunction in the storage section or the image forming apparatus due to static electricity with which the storage section is charged when the storage section is connected to or separated from the to-be-connected portion of the image forming apparatus.

In the above-described configuration in which the housing member has a guiding path and a rib, the covering member may comprise: a pressing piece for pressing a rear edge of the board assembly inserted in the guiding path of the housing member; and a pair of elastically deformable arms extending from opposite ends of the pressing piece and having claws at their ends, the housing member may have to-be-engaged portions respectively engaging with the claws of the pair of arms, and the claws may be disengaged from the to-be-engaged portions in the wake of elastic deformation of the pair of arms of the covering member.

According to this configuration, the covering member is attached to the housing member so that the claws of the covering member engage with the to-be-engaged portions of the housing member having the board assembly inserted therein to press the rear edge of the board assembly with the pressing piece, thereby readily integrating the board assembly and the housing member while determining a final position of the board assembly with respect to the housing member.

In addition, the housing member and the board assembly can be readily detached, because the covering member can be removed from the housing member by disengaging the claws from the to-be-engaged portions by elastically deforming the arms of the covering member.

In the above-described configuration in which the covering member comprises a pressing piece for pressing a rear edge of the board assembly and a pair of arms having claws at their ends, and the housing member has to-be-engaged portions engaging with the claws, the housing member may have a space in a part thereof for containing the storage element mounted on the board when the board assembly and the housing member are integrated by the covering member.

According to this configuration, the storage element mounted on the board is automatically accommodated in the space of the housing member when the board assembly and the housing member are integrated by the covering member, thereby preventing dust from attaching to the storage element and increasing reliability of the storage section.

In accordance with another aspect, the present invention provides an image forming apparatus, comprising: a latent image forming section for forming an electrostatic latent image according to image information on a photoconductive drum; a developing section for forming a toner image by supplying a toner to the formed electrostatic latent image; a toner supplying section for supplying the toner to the developing section; and a controlling section for controlling the latent image forming section, the developing section, and the toner supplying section, wherein the toner supplying section has a to-be-connected portion to be connected with the storage section of the above-described toner cartridge according to the present invention when the toner cartridge is removably mounted, and the controlling section reflects specific information of the toner cartridge read from the storage section of the toner cartridge through the to-be-connected portion in control of at least one of the latent image forming section, the developing section, and the toner supplying section.

According to this configuration, the controlling section reflects the read specific information in control of at least one of the latent image forming section, the developing section, and the toner supplying section, and therefore, when a non-genuine toner cartridge is mounted, for example, image forming conditions can be controlled so that the image quality is daringly reduced to aim at prevention of use of the non-genuine toner cartridge, or the image forming conditions can be controlled to be changed according to the lot No. of the toner cartridge so that toner physical properties that vary every lot No. of the toner cartridge will not affect the image quality.

Or, the start date of use and the actual total time of use of the toner cartridge can be stored to be kept as the history information of the toner cartridge so that it will be utilized for recycling after collection.

Hereinafter, an image forming apparatus according to embodiment of the present invention will be described in detail with reference to the drawings.

Entire Configuration and Operation of Image Forming Apparatus

Figure 2:
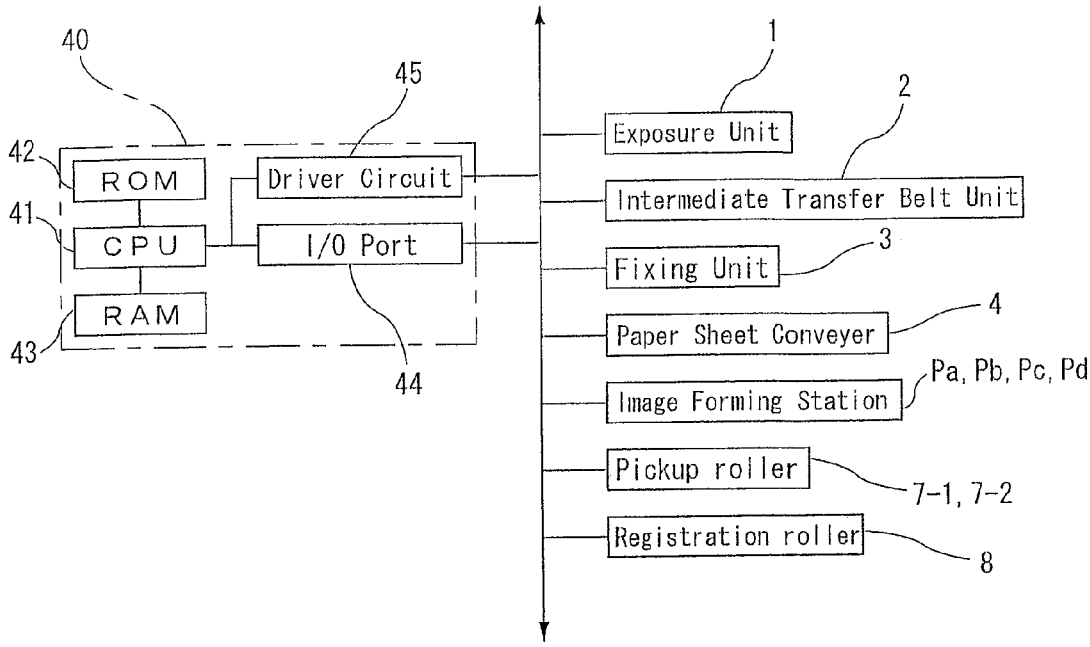
FIG. 2 is a block diagram illustrating a configuration of a controlling section for controlling the image forming apparatus illustrated in FIG. 1.

FIG. 1 is an explanatory diagram schematically illustrating an entire configuration of an image forming apparatus according to the present embodiment, and FIG. 2 is a block diagram illustrating a configuration of a controlling section for controlling the image forming apparatus illustrated in FIG. 1.

As illustrated in FIG. 1, the image forming apparatus 100 according to the embodiments of the present invention is a color laser printer that records a color image on a paper sheet. The image forming apparatus 100 comprises: an exposure unit 1; image forming stations Pa, Pb, Pc, Pd; an intermediate transfer belt unit 2; a fixing unit 3; a paper sheet conveyer 4; a paper feeding tray 5; a paper exit tray 6; and so on.

In the image forming apparatus 100, paper sheets are loaded in the paper feeding tray 5 and taken out from the paper feeding tray 5 one by one by a pickup roller 7-1 to be conveyed to a registration roller 8 by a conveyance roller 4-1. Alternatively, the paper sheets are disposed on a manual paper feeding tray 9 and taken out by a pickup roller 7-2 to be conveyed to the registration roller 8 by conveyance rollers 4-6 to 4-4.

The registration roller 8 stops a paper sheet once to align an end of the paper sheet, and conveys the paper sheet to a secondary transfer roller 33 at the time when the end of the paper sheet overlaps with an end of a toner image formed on an intermediate transfer belt 11 in the intermediate transfer belt unit 2.

The image forming stations Pa to Pd form toner images of black (K), cyan (C), magenta (M), yellow (Y), respectively, and the toner images of each color are transferred to the intermediate transfer belt 11 in the intermediate transfer belt unit 2.

The image forming stations Pa to Pd comprise developing devices 21*a*, 21*b*, 21*c*, 21*d*, toner cartridges 22*a*, 22*b*, 22*c*, 22*d*, photoconductive drums 23*a*, 23*b*, 23*c*, 23*d*, charging devices 24*a*, 24*b*, 24*c*, 24*d*, and cleaner units 25*a*, 25*b*, 25*c*, 25*d*, respectively.

The photoconductive drums 23*a* to 23*d* are pressed against primary transfer rollers 26*a*, 26*b*, 26*c*, 26*d*, respectively, via the intermediate transfer belt 11, and rotated together with the intermediate transfer belt 11 at a peripheral speed that is the same as that of the intermediate transfer belt 11 rotationally moving in a moving direction B. In addition, each of the primary transfer rollers 26*a* to 26*d* is also rotated following the intermediate transfer belt 11 at the peripheral speed that is the same as that of the intermediate transfer belt 11 rotationally moving in the moving direction B.

The charging devices 24*a* to 24*d* are of a roller type or a brush type, in case of which they contact with the photoconductive drums 23*a* to 23*d*, respectively, or of a charger type, and they uniformly charge surfaces of the photoconductive drums 23*a* to 23*d*.

The exposure unit 1 has a laser beam source 1*a* for emitting laser beams to the respective photoconductive drums 23*a* to 23*d*, and a plurality of mirrors 1*b* for leading the emitted laser beams to the respective photoconductive drums 23*a* to 23*d*. The exposure unit 1 applies the laser beams to the surfaces of the respective photoconductive drums 23*a* to 23*d* while modulating each laser beam according to image data to form electrostatic latent images on the surfaces of the respective photoconductive drums 23*a* to 23*d*.

Here, a writing head in which light-emitting devices such as EL and LED are arranged in an array may be used as the exposure unit 1.

The toner cartridges 22*a* to 22*d* contain toners of black, yellow, magenta, and cyan, respectively. The toner cartridges 22*a* to 22*d* supply the toners to the developing devices 21*a* to 21*d*, respectively. The developing devices 21*a* to 21*d* attach the toners of each color to the electrostatic latent images on the surfaces of the photoconductive drums 23*a* to 23*d* to form toner images of each color on the surfaces of the photoconductive drums 23*a* to 23*d*. The toner images of each color are transferred from the photoconductive drums 23*a* to 23*d* to the intermediate transfer belt 11 to be superimposed.

The intermediate transfer belt unit 2 comprises the intermediate transfer belt 11, the primary transfer rollers 26*a* to 26*d*, a drive support roller 31, a driven support roller 32, and the secondary transfer roller 33. The drive support roller 31 and the driven support roller 32 stretch the intermediate transfer belt 11 in such a way as to allow rotational move of the belt, and the primary transfer rollers 26*a* to 26*d* and the secondary transfer roller 33 are pressed against the stretched intermediate transfer belt 11.

The intermediate transfer belt 11 is formed, for example, of a synthetic resin film having a thickness of approximately 100 μm to 150 μm. The secondary transfer roller 33 is movably supported in a right-and-left direction of the figure, and sandwiches the intermediate transfer belt 11 with the drive support roller 31 to form a nip area when moved to the right direction.

The drive support roller 31 is rotationally driven while acting a role as a backup roller for pressing the intermediate transfer belt 11 against the secondary transfer roller 33, and rotationally moves the intermediate transfer belt 11 in the moving direction B so that each nip area between the primary transfer rollers 26*a* to 26*d* and the photoconductive drums 23*a* to 23*d* moves to a downstream side sequentially. Thereby, each nip area is stably maintained.

In order to form each nip area between the primary transfer rollers 26*a* to 26*d* and the photoconductive drums 23*a* to 23*d* more stably, it is preferable that either one of the primary transfer rollers 26*a* to 26*d* or the photoconductive drums 23*a* to 23*d* is formed of a rigid material and the other is formed of an elastic material.

The primary transfer rollers 26*a* to 26*d* are produced by, for example, coating an outer periphery of a metallic shaft having a diameter of 8 mm to 10 mm with a conductive elastomer (EPDM, foamed urethane, etc.)

A bias voltage of a polarity opposite to the charge polarity of the toner is applied to the primary transfer rollers 26*a* to 26*d*, while the intermediate transfer belt 11 is sandwiched in the nip areas between the primary transfer rollers 26*a* to 26*d* and the photoconductive drums 23*a* to 23*d*.

An electric field generated by the application of the bias voltage acts on the toners on the surfaces of the photoconductive drums 23*a* to 23*d* via the intermediate transfer belt 11, and the toners on the surfaces of the photoconductive drums 23*a* to 23*d* are attracted and transferred to the intermediate transfer belt 11. Thereby, the toner images of each color are transferred to the intermediate transfer belt 11 to be superimposed.

Instead of rollers, brushes or the like may be used as the primary transfer rollers 26*a* to 26*d*.

A cleaning unit 34 is, for example, a cleaning blade that slidably contacts with a surface of the intermediate transfer belt 11, and removes a toner remaining on the surface of the intermediate transfer belt 11 to prevent fogging of an image to be printed next.

Thus, a multicolor (color) toner image that has been transferred to the intermediate transfer belt 11 and superimposed is conveyed to the nip area between the drive support roller 31 and the secondary transfer roller 33 as the intermediate transfer belt 11 rotationally moves.

The registration roller 8 conveys a paper sheet to the nip area at the time when an end of the multicolor toner image and an end of the paper sheet conveyed to the nip area come to the same position, and the multicolor toner image is transferred onto the paper sheet.

Subsequently, the paper sheet is conveyed to the fixing unit 3 where the paper sheet is sandwiched between a pressure roller 3*a* and a heat roller 3*b*. Thereby, the multicolor toner image on the paper sheet is heated and fused, and fixed as a color image on the paper sheet by a sticking effect.

Thereafter, the paper sheet is ejected to the paper exit tray 6 by the paper sheet conveyer 4 and disposed on the paper exit tray 6 with a surface on which the image is formed facing down, that is, by a face-down method.

Here, it is possible to form a monochrome image by using only the image forming station Pa, and transfer the monochrome image to the intermediate transfer belt 11 in the intermediate transfer belt unit 2. The monochrome image is also transferred from the intermediate transfer belt 11 to a paper sheet to be fixed on the paper sheet as in the case of the color image.

In addition, when printing is carried out not only on a face but also on both faces of a paper sheet, a toner image transferred onto one face of a paper sheet is fixed in the fixing unit 3, and then the paper sheet is conveyed toward the paper exit tray 6 by a conveyance roller 4-3, and during that time, the conveyance roller 4-3 is stopped and then inversely rotated to pass the paper sheet through a reverse path 4*r* to reverse the paper sheet and then lead the paper sheet to the registration roller 8. Subsequently, the toner image is transferred and fixed onto the other face of the paper sheet as in the case of the image formation on the one face, and the paper sheet is ejected to the paper exit tray 6.

Though not shown in FIG. 1, the image forming apparatus 100 comprises a controlling section for collectively performing overall control. As illustrated in FIG. 2, the controlling section 40 is a microcomputer including: a CPU 41 for carrying out processing; a ROM 42 for storing a control program to be executed by the CPU 41; a RAM 43 for providing a work area to the CPU 41; an I/O port 44 for inputting and outputting control signals with various sensors of the image forming apparatus 100 under control by the CPU 41; and a driver circuit 45 for driving various driving sections provided to the image forming apparatus 100 under control by the CPU 41, and the controlling section 40 performs overall control of the image forming apparatus 100 including the exposure unit 1 (latent image forming section) and the image forming stations Pa to Pd (developing section and toner supplying section).

Configuration of Toner Cartridge

The toner cartridges 22*a* to 22*d* are removably mounted in the image forming stations Pa to Pd, respectively. Specifically, the toner cartridges 22*a* to 22*d* will be removably mounted in the developing devices 21*a* to 21*d* in the image forming stations Pa to Pd, respectively.

Hereinafter, the toner cartridges 22*a* to 22*d* will be described. In this description, however, the reference numerals of the toner cartridges will be 22, and the reference numerals of the developing devices will be 21 for simplification.

Figure 3:
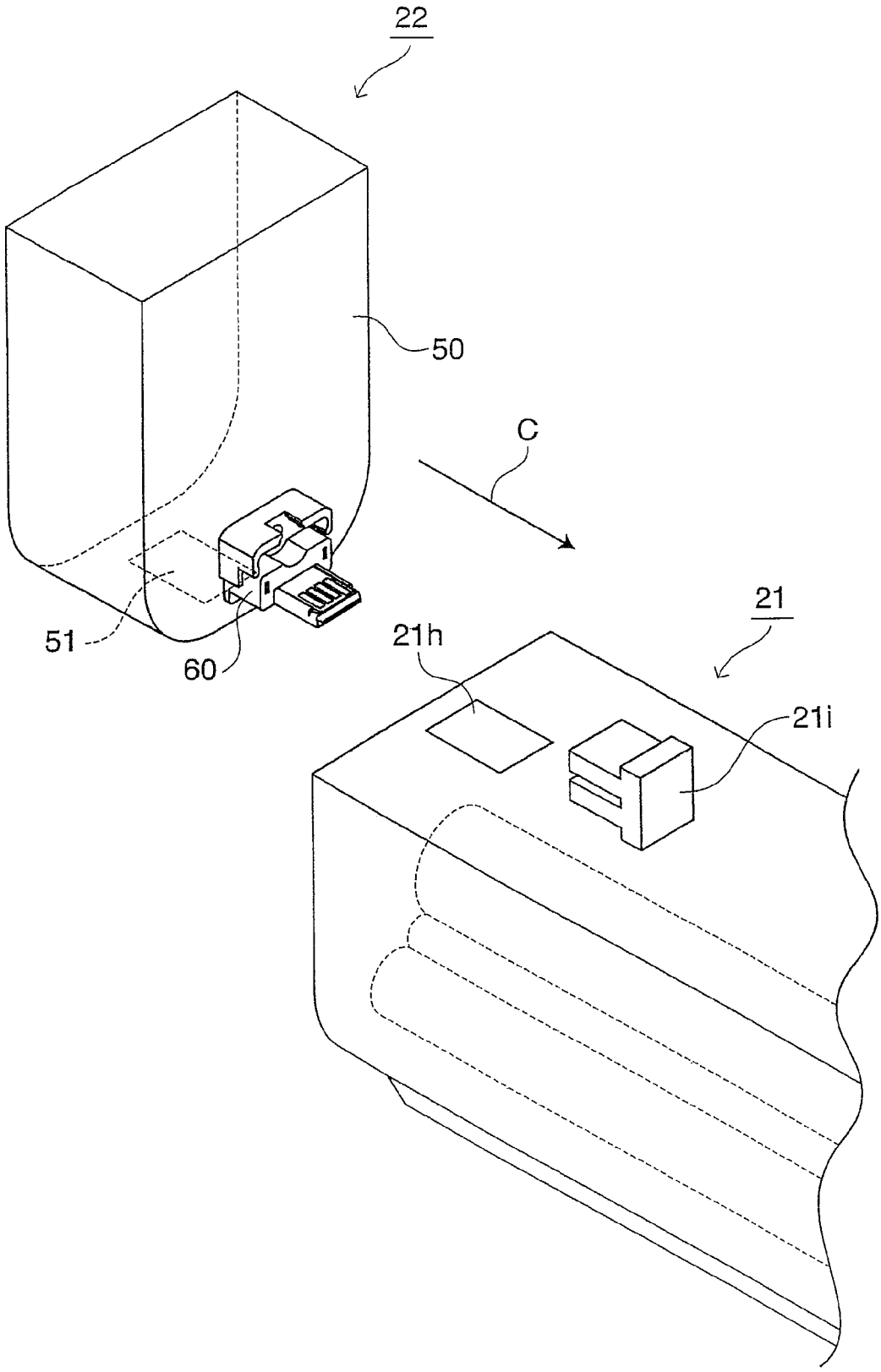
FIG. 3 is a perspective view illustrating a toner cartridge to be mounted in the image forming apparatus illustrated in FIG. 1 together with a developing device.

FIG. 3 is a perspective view illustrating a toner cartridge and a developing device in which the toner cartridge is mounted according to an embodiment of the present invention.

As illustrated in FIG. 3, the toner cartridge 22 includes a toner container 50 for containing a toner, and a storage section 60 provided so as to be attached to and removed from the toner container 50 for storing specific information held by the toner container 50 as electronic information.

The storage section 60 stores the specific information held by the toner container 50 as electronic information for the following purposes: prevention of use of a non-genuine toner cartridge, change of image forming conditions according to lot No., warning when the toner cartridge 22 of a wrong color is mounted by mistake, detection of when to replace the toner cartridge 22, prevention of recycling beyond the upper limit of the number of times, follow-up investigation in case of a defective product, and so on.

The specific information can be roughly classified to the following three kinds of information: body information, history information, and recycling information. The body information includes: product number, capacity, toner color, lot No., production date, name of manufacturer, address and phone number of manufacturer, and the like.

The history information includes: amount of remaining toner, start date of use, actual total time of use, cumulative usage data (for example, cumulative number of printed sheets), and the like.

The recycling information includes: number of times of recycling, date of recycling, name of collector, address and phone number of collector, and the like.

As illustrated in FIG. 3, once the toner cartridge 22 is mounted in the developing device 21, a toner outlet port 51 of the toner container 50 and a toner inlet port 21*h* of the developing device 21 come to the same position to allow supply of the toner, and at the same time, the storage section 60 provided to the toner container 50 is electrically connected to a to-be-connected portion 21*i* provided to the developing device 21.

Though not shown, a shutter is provided to the toner outlet port 51 of the toner container 50 and the toner inlet port 21*h* of the developing device 21, and the shutter opens only when the toner cartridge 22 is mounted in the developing device 21 so that the toner outlet port 51 communicates with the toner inlet port 21*h*.

When the toner cartridge 22 is mounted in the developing device 21, the above-described controlling section 40 (see FIG. 2) reads out the above-described specific information stored in the storage section 60 via the to-be-connected portion 21*i* of the developing device 21 to judge whether or not the mounted toner cartridge 22 is a genuine product conforming to the model and whether or not the toner cartridge 22 of a wrong color is mounted by mistake.

Then, when the mounted toner cartridge 22 is judged to be not conforming to the model or to be a non-genuine product, a warning is issued to urge replacement with the toner cartridge 22 that is a genuine product conforming to the model.

When printing of an image is requested without replacement of the toner cartridge 22 despite a warning to urge replacement with a genuine product conforming to the model, the controlling section 40 provides control to intentionally preclude a desired image density from being obtained by changing a developing bias and the like and decreasing a developing potential gap.

This is because, when a non-genuine toner cartridge (false product) is mounted, the physical properties of the toner are different from predetermined required values, and therefore more toner scattering is expected in the apparatus to cause more internal stains, inducing a failure in the image forming apparatus 100 (see FIG. 1).

With the control to intentionally preclude a desired image density from being obtained, users cannot obtain printing of desired image quality unless replacing the toner cartridge 22 with a genuine product conforming to the model.

In addition, the toner cartridges 22 sharing the same product number may have slightly different toner physical properties depending on the lot No., and this difference may affect the image quality, in particular, developing density.

Therefore, the controlling section 40 provides control to correct gamma characteristics by delicately changing laser power for exposure according to the lot No. read out.

Figure 4:
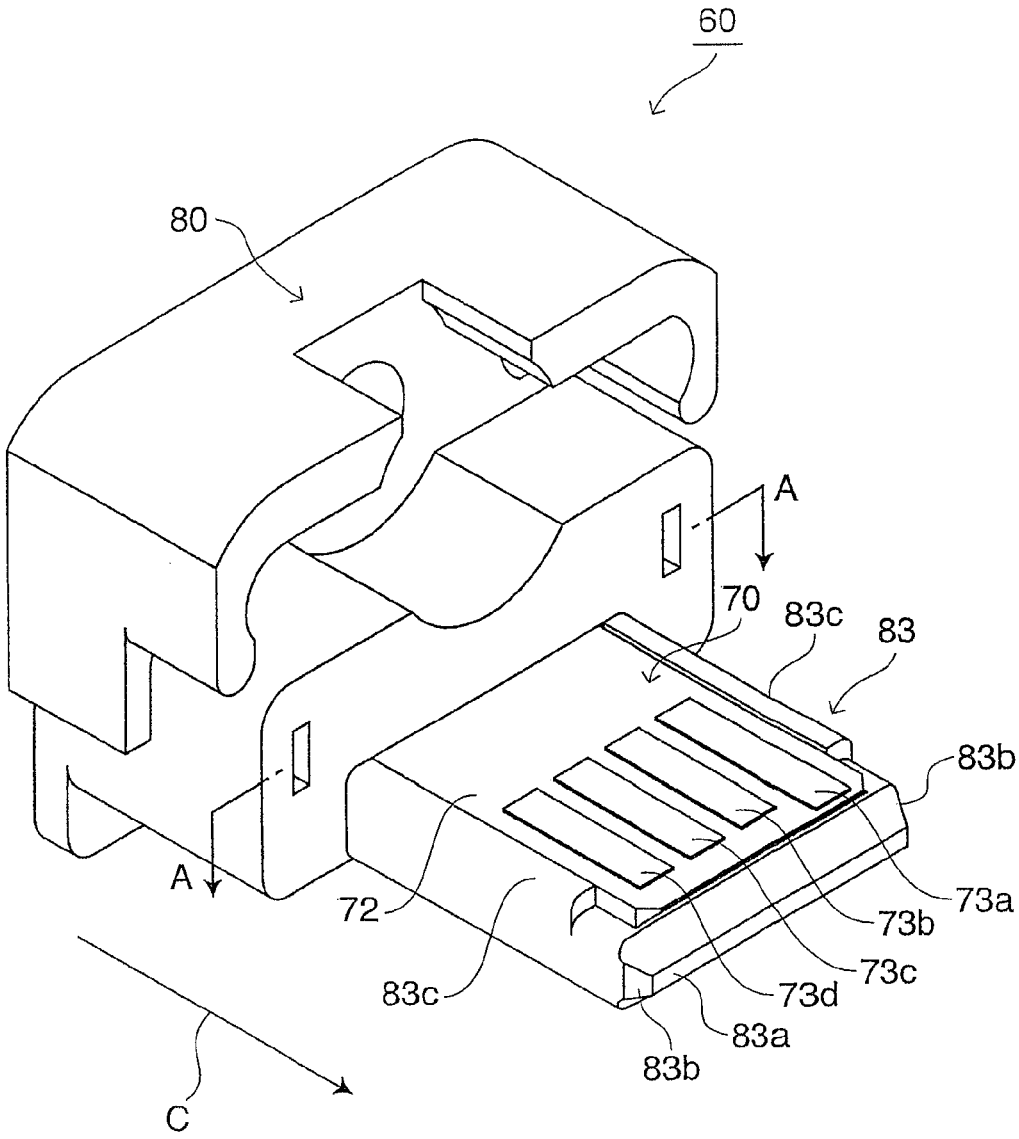
FIG. 4 is a perspective view of a storage section to be mounted in the toner cartridge illustrated in FIG. 3.

Next, the configuration of the storage section will be described in detail. FIG. 4 is a perspective view of the storage section, FIG. 5 is an exploded perspective view of the storage section, and FIG. 6 is a sectional view taken along a line A-A in FIG. 4.

Figure 5:
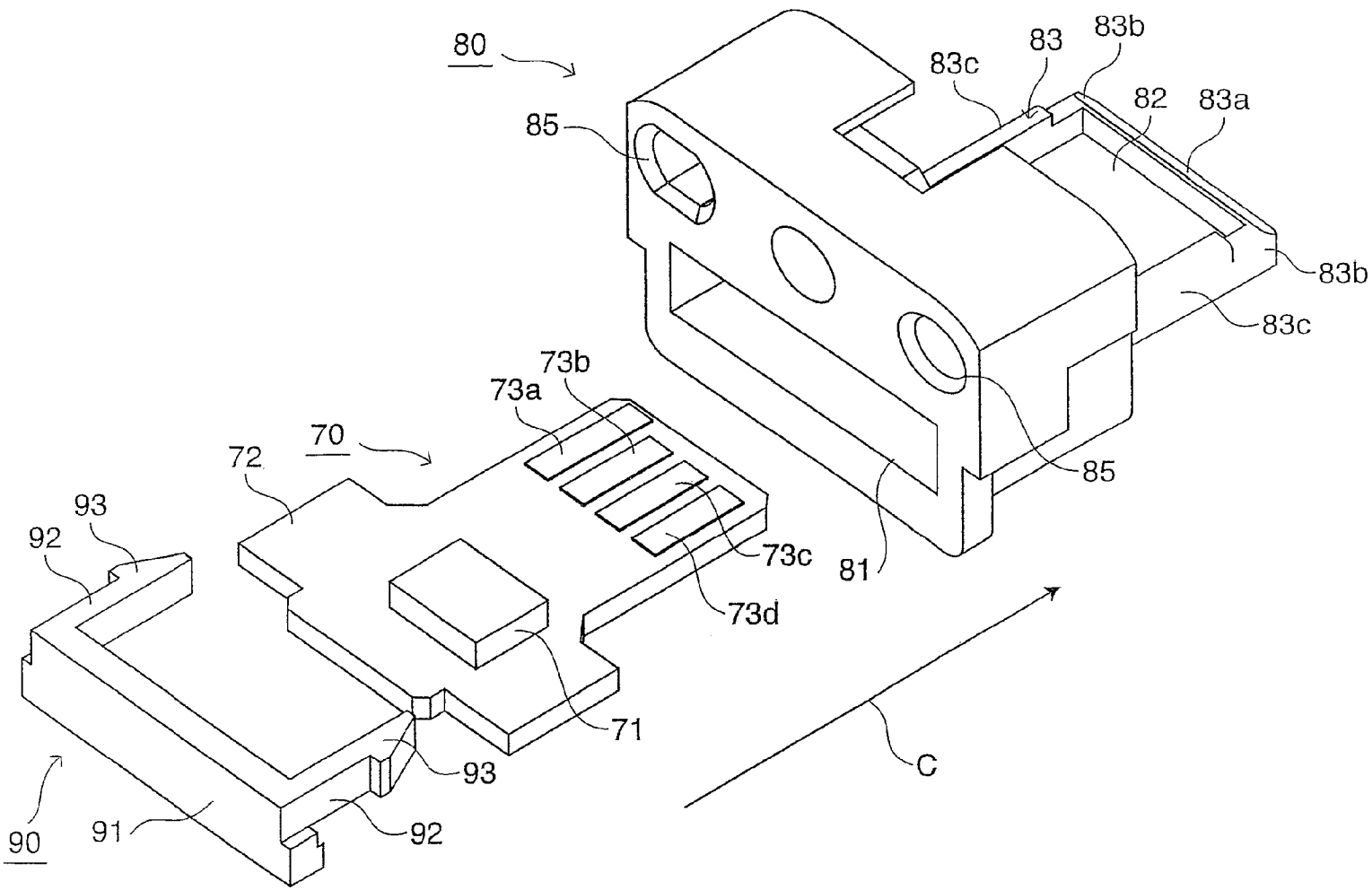
FIG. 5 is an exploded perspective view of the storage section illustrated in FIG. 4.
Figure 6:
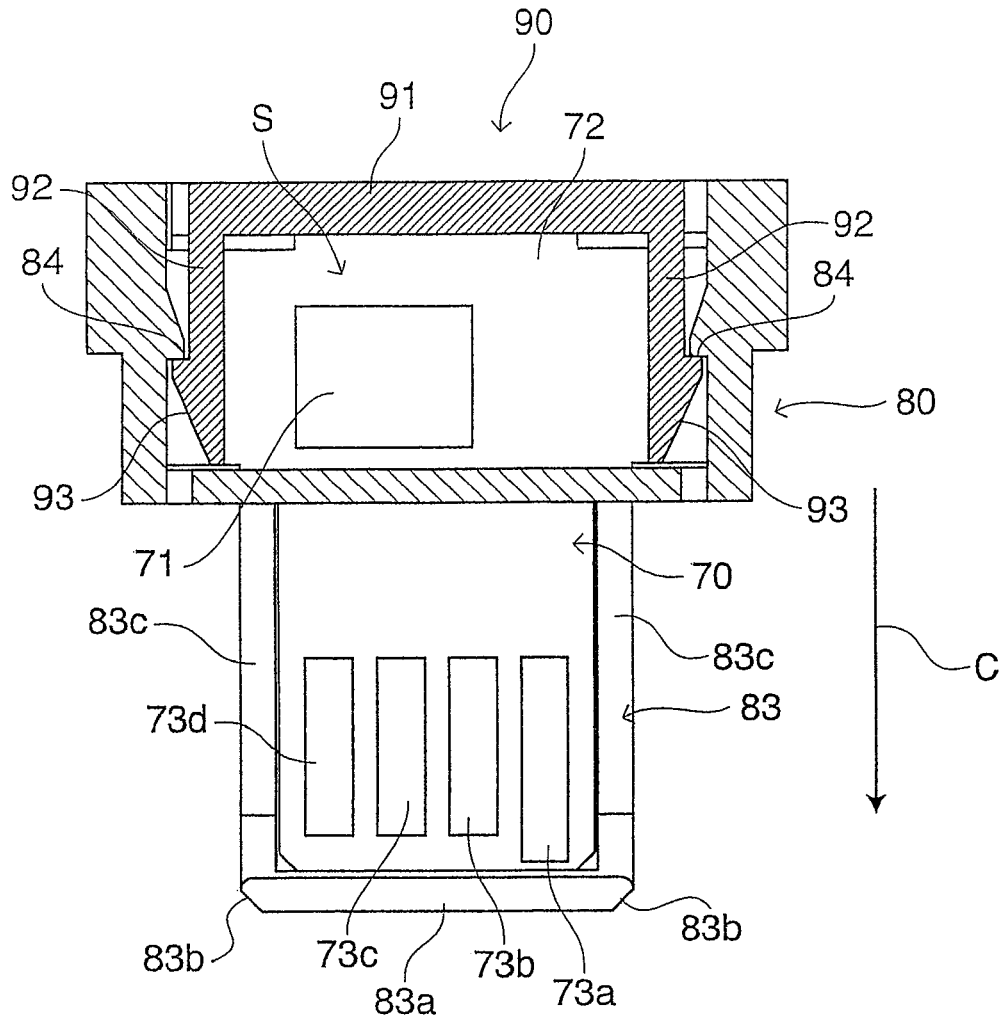
FIG. 6 is a sectional view of the storage section illustrated in FIG. 4 taken along a line A-A.

As well illustrated in FIGS. 4 to 6, in particular, in FIG. 5, the storage section 60 is mainly composed of three members.

That is, the storage section 60 is composed of the following three members: a board assembly 70 including a board 72 on which a storage element 71 for storing specific information mounted; a housing member 80, made of a resin, for holding the board assembly 70; and a covering member 90, made of a resin, for detachably integrating the board assembly 70 and the housing member 80.

On a surface of the board 72 included in the board assembly 70, there are formed four electrode terminals 73*a*, 73*b*, 73*c*, 73*d* extending from the storage element 71 and aligned in parallel along a connecting direction C in which the toner cartridge is connected to the to-be-connected portion 21*i* of the developing device 21 (see FIG. 3).

Though not shown, similar four electrode terminals are formed also in the to-be-connected portion 21*i* to exchange signals with the electrode terminal 73*a* to 73*d* of the storage section 60.

The housing member 80 has an insertion port 81 provided at a rear side of the housing member 80, to which the board assembly 70 is inserted; a guiding path 82 extending from the insertion port 81; and a rib 83 formed so as to rise from edges of the guiding path 82 to define the guiding path 82.

The rib 83 is formed so as to surround the guiding path 82 from three directions, that is, from opposite side edges and a front end of the guiding path 82, to position the board assembly 70 at a predetermined position in the housing member 80 by contacting with an edge of the board assembly 70 inserted from the insertion port 81.

In order to prevent the board assembly 70 from being inserted to the housing member 80 upside down, the storage element 71 is mounted and the electrode terminals 73*a* to 73*d* are formed only at a front surface side of the board 72 included in the board assembly 70.

In addition, the rib 83 surrounding the guiding path 82 from the three directions of the opposite side edges and the front end of the guiding path 82 includes a front end 83*a* to be a front end of the storage section 60 when the storage section 60 is connected to the to-be-connected portion 21*i*. The front end 83*a* is formed so as to be rounded by removing sharpness of both ends 83*b* leading to side edges 83*c*. Furthermore, the front end 83*a* is formed so as to have a gradually decreasing thickness in a part facing the to-be-connected portion 21*i* as it approaches the to-be-connected portion 21*i*.

As a result, the storage section 60 is prevented from being caught by the to-be-connected portion 21*i* when the toner cartridge 22 is mounted into the developing device 21, thereby facilitating smooth connection.

The covering member 90 for detachably integrating the board assembly 70 and the housing member 80 comprises a pressing piece 91 for pressing a rear edge of the board assembly 70 inserted in the guiding path 82 of the housing member 80, and a pair of arms 92 extending from opposite ends of the pressing piece 91 and having claws 93 at front ends thereof. The pair of arms 92 are elastically deformable.

When the covering member 90 is inserted to the insertion port 81 of the housing member 80 so that the pressing piece 91 of the cover member 90 presses the rear edge of the board assembly 70, after the board assembly 70 is inserted to the guiding path 82 of the housing member 80, the pair of arms 92 are elastically deformed temporarily, and the claws 93 formed at the front ends of the arms 92 disengageably engage with to-be-engaged portions 84 (see FIG. 6) formed on both side faces of the guiding path 82 of the housing member 80, respectively.

Thereby, the covering member 90 is fixed with respect to the housing member 80, and assembly of the storage section 60 is completed. Once the covering member 90 is inserted to the insertion port 81 of the housing member 80, and the claws 93 engage with the to-be-engaged portions 84, the storage element 71 mounted on the board 72 as illustrated in FIG. 6 is contained in a space S in the housing member 80 to be protected from an external shock and attachment of dust.

The assembled storage section 60 is fixed to the toner container 50 (see FIG. 3) with a screw through fixing holes 85 formed in the housing member 80. Therefore, when the number of times of the recycling of the toner cartridge 22 (see FIG. 3) reaches the upper limit thereof, the storage section 60 can be readily removed from the toner container 50 by taking off the screw to reuse the storage section 60.

When the removed storage section 60 has any damage, and the storage section 60 needs to be disassembled, the claws 93 and the to-be-engaged portions 84 are disengaged respectively by elasticity deforming the pair of arms 92 of the covering member 90 inward so that they approach each other, and then the covering member 90 is pulled out of the insertion port 81 of the housing member 80.

Then, the board assembly 70 is pulled out of the insertion port 81 of the housing member 80, thereby readily disassembling the storage section 60 into the three members: the board assembly 70, the housing member 80, and the covering member 90.

And then, the storage section 60 can be reused by replacing a damaged component and reassembling the storage section 60 as appropriate.

It is needless to say that appropriate disposal is possible by carrying out disassembly in the above-described manner even when disposing of the storage section 60.

As illustrated in FIGS. 4 to 6, the four electrode terminals 73*a*, 73*b*, 73*c*, 73*d* formed on the board 72 are a ground terminal, an input terminal, a control voltage terminal, an output terminal, respectively, and among these four electrode terminals 73*a* to 73*d*, the electrode terminal 73*a* acting as the ground terminal has an end extending in the connecting direction C toward the to-be-connected portion 21*i* (see FIG. 3) longer than the other electrode terminals 73*b*, 73*c*, 73*d*.

Therefore, when the storage section 60 is connected to the to-be-connected portion 21*i*, the electrode terminal 73*a* acting as the ground terminal is first connected to the to-be-connected portion 21*i* before the connection of the other terminals 73*b*, 73*c*, 73*d*.

In addition, when the storage section 60 is separated from the to-be-connected portion 21*i*, the electrode terminal 73*a* acting as the ground terminal is separated last after the separation of the other electrode terminals 73*b*, 73*c*, 73*d*.

Containing a toner, which is a fine powder, the toner container 50 of the toner cartridge 22 is prone to be charged with static electricity due to flow of the toner. In particular, the toner container 50 can be charged with as much as thousands volt of static electricity in a low-humidity environment in winter.

And, if the static electricity gets on the storage section 60 via the toner container 50, the static electricity on the storage section 60 is discharged in bursts when the storage section 60 is connected to the to-be-connected portion 21*i*.

This discharge appears as noise of the storage section 60 to counteract correct detection of an output voltage from the storage section 60 or to be detected as an abnormal voltage value, causing malfunction in the storage section 60 or the image forming apparatus 100.

In the present embodiment, however, the electrode terminal 73*a* acting as the ground terminal is formed to be longer than the other electrode terminals 73*b*, 73*c*, 73*d* in the connecting direction C, and therefore the electrode terminal 73*a* acting as the ground terminal is connected earlier than the other electrode terminals 73*b*, 73*c*, 73*d* when the storage section 60 is connected to the to-be-connected portion 21*i*.

Therefore, the other electrode terminals 73*b*, 73*c*, 73*d* will be connected after the storage section 60 is grounded through the electrode terminal 73*a* acting as the ground terminal.

In addition, when the storage section 60 is separated from the to-be-connected portion 21*i*, the storage section 60 will stay grounded while the other electrode terminals 73*b*, 73*c*, 73*d* are connected to the to-be-connected portion 21*i*, because the electrode terminal 73*a* acting as the ground terminal is separated later than the other terminals 73*b*, 73*c*, 73*d*.

Therefore, it is possible to prevent malfunction in the storage section 60 or the image forming apparatus 100 due to static electricity with which the storage section 60 is charged when the storage section 60 is connected to or separated from the to-be-connected portion 21*i*.

Although preferred embodiment of the present invention has been described with reference to the drawings, it is needless to say that the present invention is not limited to the above-described embodiment. It will be obvious that those of ordinary skill in the art can conceive of various modifications or improvements on the basis of the technical idea of the present invention.

What is claimed is:

1. A toner cartridge, comprising:

a toner container for containing a toner, the toner container being removably mounted in an image forming apparatus; and a storage section for electronically storing specific information held by the toner container, the storage section being electrically connected to a to-be-connected portion of the image forming apparatus when the toner container is mounted in the image forming apparatus, the storage section comprising:

a board assembly including a board on which a storage element for storing the specific information held by the toner container as electronic information is mounted;

a housing member for holding the board assembly; and a covering member for detachably integrating the board assembly and the housing member, the storage section being attachable to and removable from the toner container.

2. The toner cartridge as set forth in claim 1, wherein the housing member has a guiding path to which the board assembly is inserted and a rib contacting with an edge of the board assembly inserted to the guiding path for positioning the board assembly to a predetermined position in the housing member.

3. The toner cartridge as set forth in claim 2, wherein the rib of the housing member comprises: side edges respectively formed so as to rise from opposite edges of the guiding path; and a front end formed so as to rise from an end of the guiding path and joining ends of the side edges together, the front end acts as a front end of the storage section when the storage section is electrically connected to the to-be-connected portion of the image forming apparatus, and both ends of the front end linked to the side edges are rounded.

4. The toner cartridge as set forth in claim 1, wherein the board assembly has a plurality of electrode terminals extending from the storage element on the board and electrically connected to the to-be-connected portion of the image forming apparatus when the toner container is mounted in the image forming apparatus, and the plurality of electrode terminals are arranged so as to line up on the board in parallel along a connecting direction toward the to-be-connected portion.

5. The toner cartridge as set forth in claim 4, wherein the plurality of electrode terminals include at least one ground terminal, and an end of the ground terminal extends toward the connecting direction longer than the other terminals.

6. The toner cartridge as set forth in claim 2, wherein the covering member comprises: a pressing piece for pressing a rear edge of the board assembly inserted in the guiding path of the housing member; and a pair of elastically deformable arms extending from opposite ends of the pressing piece and having claws at their ends, the housing member has to-be-engaged portions respectively engaging with the claws of the pair of arms, and the claws are disengaged from the to-be-engaged portions in the wake of elastic deformation of the pair of arms of the covering member.

7. An image forming apparatus, comprising:

a latent image forming section for forming an electrostatic latent image according to image information on a photoconductive drum;

a developing section for forming a toner image by supplying a toner to the formed electrostatic latent image;

a toner supplying section for supplying the toner to the developing section; and a controlling section for controlling the latent image forming section, the developing section, and the toner supplying section, wherein the toner supplying section has a to-be-connected portion to be connected with the storage section of the toner cartridge as set forth in claim 1 when the toner cartridge is removably mounted, and the controlling section reflects specific information of the toner cartridge read from the storage section of the toner cartridge through the to-be-connected portion in control of at least one of the latent image forming section, the developing section, and the toner supplying section.

* * * * *